US005857573A

United States Patent [19]

Pakeriasamy

[11] Patent Number: 5,857,573

[45] Date of Patent: Jan. 12, 1999

[54] TRAY FOR SHIPPING PCMCIA CARDS

[75] Inventor: Saragarvani Pakeriasamy, San Jose, Calif.

[73] Assignee: Advanced Micro Devices, Inc., Sunnyvale, Calif.

[21] Appl. No.: 7,671

[22] Filed: Jan. 15, 1998

[51] Int. Cl.[6] ..... B65D 85/30

[52] U.S. Cl. ..... 206/723; 206/485; 206/454

[58] Field of Search ..... 206/701, 707, 206/709, 711, 722, 723, 725, 485, 425, 454

[56] References Cited

U.S. PATENT DOCUMENTS 4,461,384 7/1984 Erlam ..... 206/485 X 5,458,237 10/1995 Kataoka ..... 206/723

*Primary Examiner*—Jacob K. Ackun

*Attorney, Agent, or Firm*—Davis Chin

[57] ABSTRACT

A PCMCIA card carrier for packing and shipping of a plurality of PCMCIA cards in a vertical side-by-side arrangement is formed of a tray member and a cover member. The tray member includes a plurality of first vertical slots disposed therein. A plurality of PCMCIA cards are disposed in the plurality of first vertical slots. The cover member has a plurality of second vertical slots disposed therein which are vertically aligned with corresponding ones of the first vertical slots in the tray member when the cover member is placed on top of the tray member. The tray and cover members have ledge portions in which are formed interlocking members so as to latch together the cover member with the tray member.

20 Claims, 3 Drawing Sheets

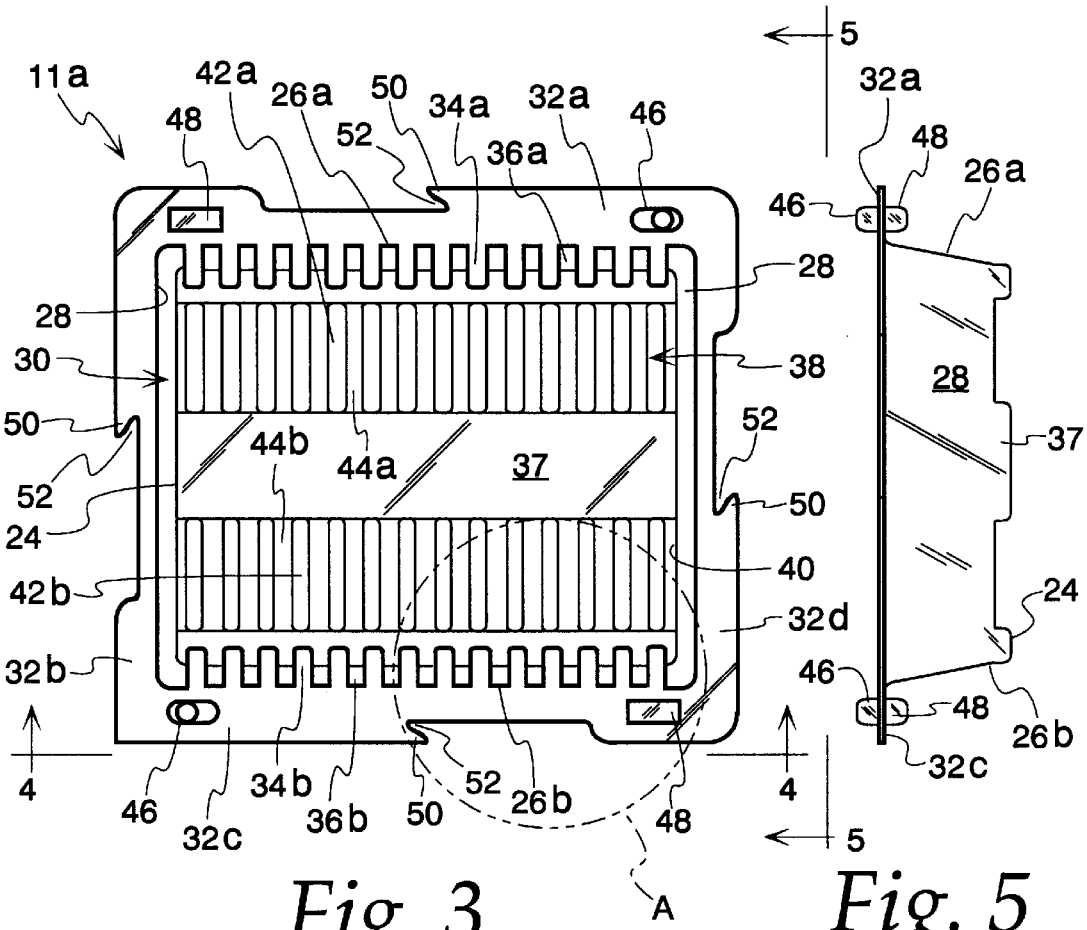
Fig. 3
Fig. 5
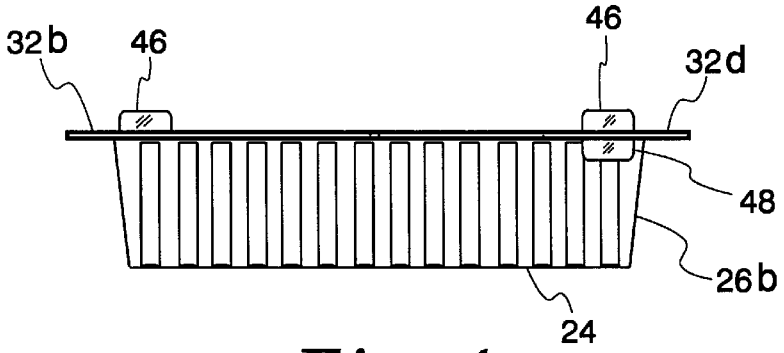
Fig. 4

TRAY FOR SHIPPING PCMCIA CARDS

BACKGROUND OF THE INVENTION

This invention relates generally to containers for packing and shipping semiconductor integrated circuits and more particularly, it relates to a tray of a unique construction adapted for especially packing and shipping a plurality of PCMCIA cards in a vertical side-by-side arrangement.

In recent years, there have been made advances in the semiconductor packaging technology for semiconductor memory integrated circuit devices. One type of memory integrated circuit device which is housed in a generally rectangularly-shaped package is referred to as a PCMCIA (an acronym for Personal Computer Memory Card International Association) card. The PCMCIA card may typically have a width dimension of about 2.125 inches, a length dimension of about 3.375 inches, and a thickness of approximately 0.125 inches. In view of this, there has arisen a need for a carrier or container for housing and/or shipping a relatively large number of these PCMCIA cards from a PCMCIA card manufacturer's location to a customer's site for subsequent use in a manufacturing process and/or equipment.

Due to the fact that these PCMCIA cards are susceptible not only to possible physical damage during the handling and shipping but as well as to destruction caused by electrostatic discharge (ESD), the containers must be able to render a certain degree of protection for these sensitive PCMCIA cards to be transported therein. At the present time, the prior art solution to these problems has involved the use of a plastic Jewel case for holding a single or individual PCMCIA card therein. For instance, there is depicted in FIG. 1 and labeled as "Prior Art" a carrier 110 of a generally rectangular configuration for housing a single PCMCIA card. The carrier 110 is shown in the "open" position and consists of a box-like shell 112 and a cover 114 hingedly connected at its rear to the box-like shell 112.

However, this prior art Jewel case 110 suffers from the disadvantage of being a very time-consuming task for loading and packing the individual PCMCIA cards therein. Further, the use of an individual plastic Jewel case 110 for each PCMCIA card increases substantially the materials cost as well as the assembly and labor costs. In addition, the plastic Jewel case 110 is not very practical to use in relationship with other manufacturing processes and/or equipment, such as a "pick and place" mechanism for performing the function of picking up the individual PCMCIA card from the Jewel case 110 and placing it in another location for testing and/or inspection.

Currently, the inventor is unaware of the use of a cost effective carrier or productive methodology for packing PCMCIA cards in the industry. Accordingly, it would be desirable to provide a tray member of a rectangular construction adapted for especially packing and shipping of a plurality of PCMCIA cards in a vertical side-by-side arrangement. Further, it would be expedient to provide a PCMCIA card tray member which can be made relatively inexpensively and which is compatible for use with other manufacturing processes and/or equipment for sequential production operations.

SUMMARY OF THE INVENTION

Accordingly, it is a general object of the present invention to provide an improved PCMCIA card tray of a rectangular construction which is relatively simple and economical to manufacture and assemble, but yet overcomes the disadvantages of the prior art plastic Jewel case.

It is an object of the present invention to provide an improved PCMCIA card tray of a unique construction for storing and shipping PCMCIA cards in a vertical side-by-side arrangement so as to protect the same from damage or possible destruction during packing and shipment.

It is another object of the present invention to provide an improved PCMCIA card carrier for packing and shipping of a plurality of PCMCIA cards which reduces packing costs and simplifies the loading and packing process.

It is still another object of the present invention to provide an improved PCMCIA card carrier for packing and shipping of a plurality of PCMCIA cards which includes a tray member having a plurality of ribs disposed in an equally spaced-apart relationship so as to form vertical slots therebetween.

It is still yet another object of the present invention to provide an improved PCMCIA card carrier for packing and shipping of a plurality of PCMCIA cards which includes locking means formed on a tray member and a cover member so as to latch together the same.

In a preferred embodiment of the present invention, there is provided a PCMCIA card carrier for packing and shipping of a plurality of PCMCIA cards in a vertical side-by-side arrangement which includes a rectangularly-shaped tray member and a rectangularly-shaped cover member. The tray member is formed of a first bottom wall, opposed first sidewalls, and opposed first end walls all integrally joined together so as to form a first central cavity portion. Each of the opposed first sidewalls includes a plurality of ribs disposed along its interior surface in an equally spaced apart relationship so as to form first vertical slots therebetween. The plurality of PCMCIA cards are disposed vertically in corresponding ones of the first vertical slots for packing and storing the same.

The cover member is formed of a second bottom wall, opposed second sidewalls, and opposed second end walls all integrally joined together so as to form a second central cavity portion. Each of the opposed second sidewalls include a plurality of second ribs disposed along its interior surface in an equally spaced apart relationship so as to form second vertical slots therebetween. The plurality of second ribs in the cover member are vertically aligned with corresponding ones of the plurality of first ribs in the tray member when the cover member is placed on top of the tray member.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 3 is a top view of the tray member in FIG. 2;

FIG. 4 is a side elevational view, taken along the lines 4—4 of FIG. 3;

FIG. 5 is an end view, taken along the lines 5—5 of FIG. 3;

DESCRIPTION OF THE PREFERRED EMBODIMENT

Figure 2:
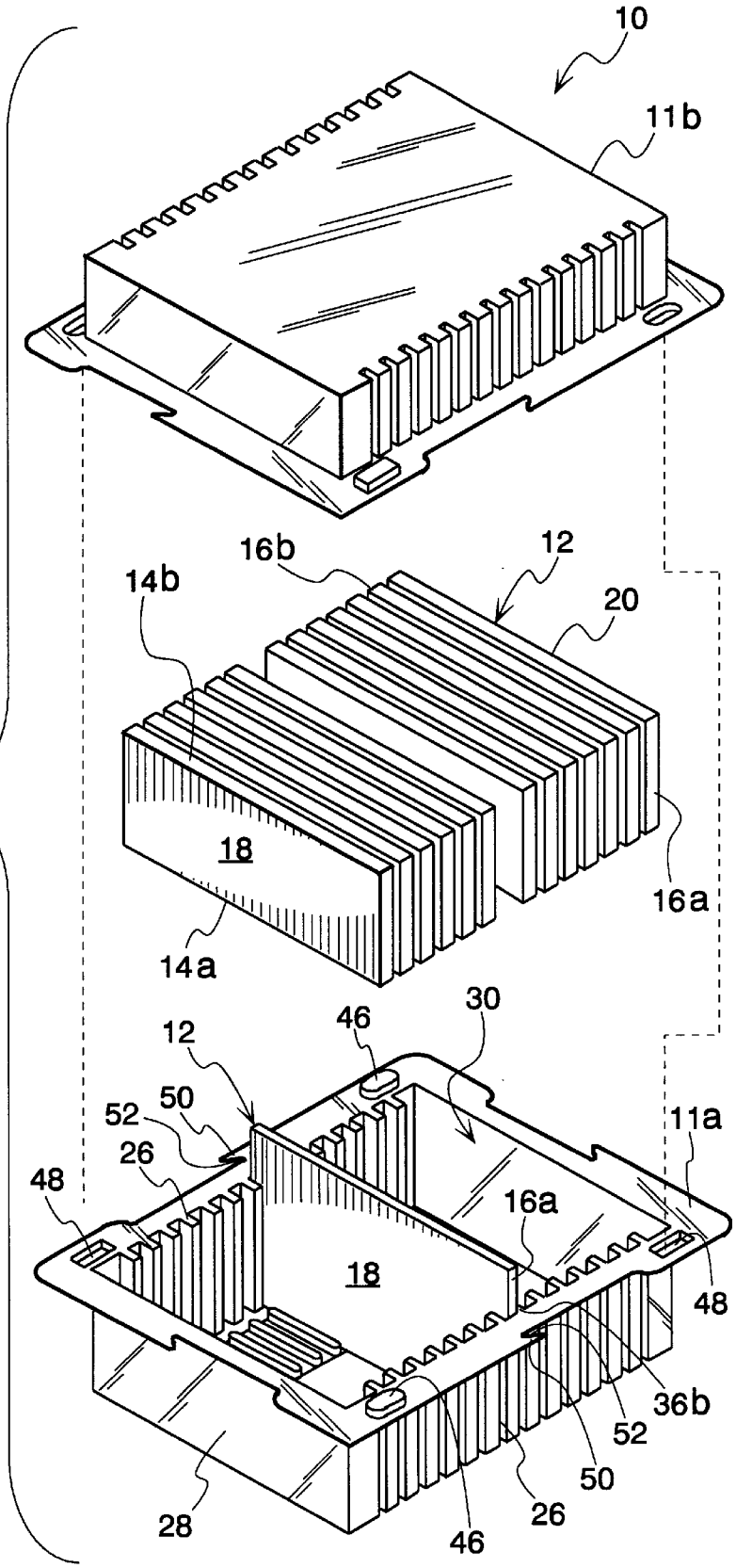
FIG. 2 is an exploded, perspective view of a PCMCIA card carrier, constructed in accordance with the principles of the present invention.

Referring now in detail to the drawings, there is shown in FIG. 2 a novel PCMCIA card carrier designated generally by reference numeral 10 and constructed in accordance with the principles of the present invention. The PCMCIA card carrier 10 is comprised of a tray member 11*a* and a cover member 11*b* which are adapted for especially packing and shipping of a plurality of PCMCIA cards 12 in a vertical side-by-side arrangement. The details of the PCMCIA card carrier tray member 11*a* are illustrated in FIGS. 3 through 6.

Figure 1:
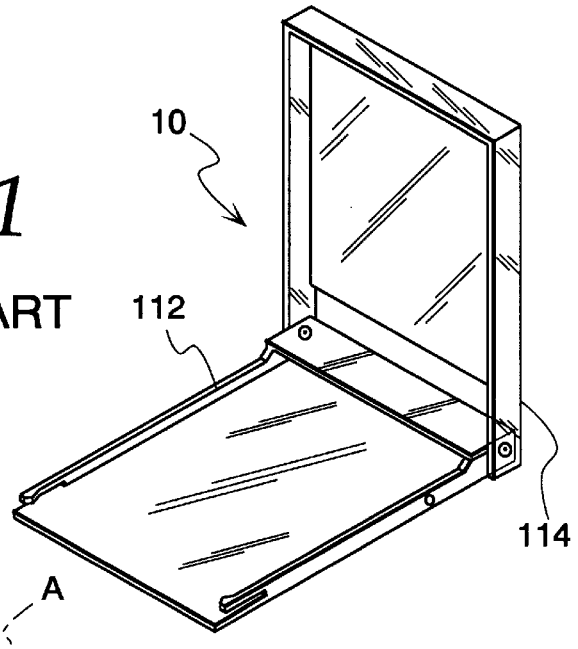
Fig. 1 PRIOR ART
FIG. 1 is a perspective view of a PCMCIA card Jewel case of the prior art.
Figure 6:
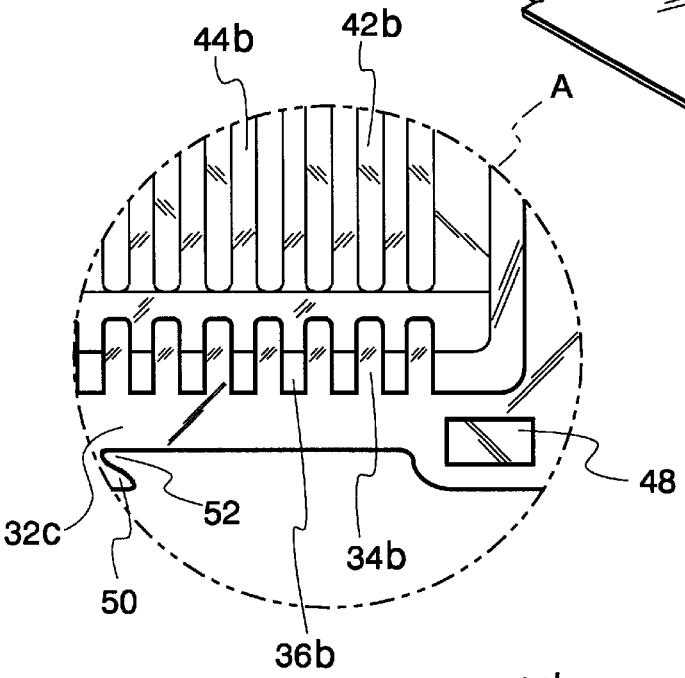
FIG. 6 is an enlarged view of the encircled area A of FIG. 3.
Figure 7:
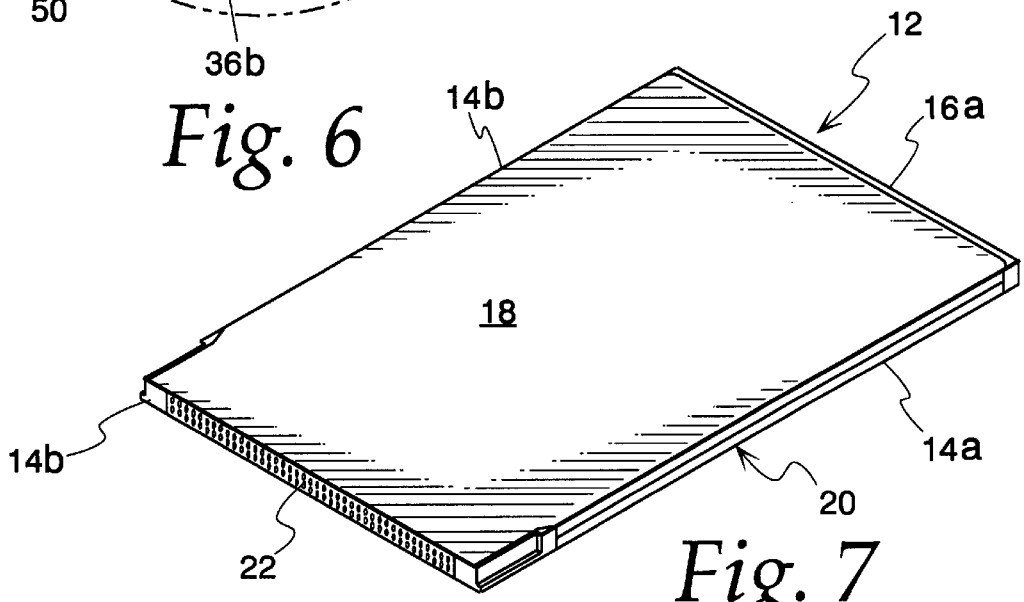
FIG. 7 is a perspective view of a PCMCIA card.

Each of the PCMCIA cards 12, (one of which is illustrated in detail in FIG. 7) is of a substantially rectangular shape having opposed side edges 14*a* and 14*b*, opposed end edges 16*a* and 16*b*, a top surface 18, and a bottom surface 20. Adjacent the end edge 16*b*, there are provided a plurality of terminal pin openings 22 which extend between the opposed side edges 14*a* and 14*b*. The PCMCIA card 12 may be similar to a 5 Volt-only, 20 Mbyte D Series Flash memory card which is manufactured and sold by Advanced Micro Devices, Inc. of Sunnyvale, Calif., under their Part No. AmC020DFLKA. In this instance, the PCMCIA card 12 has two rows of terminal pin openings, each row having thirty-four pin openings 22.

With reference to FIGS. 2 and 3–6, the PCMCIA card carrier tray member 11*a* is of a substantially rectangular-shaped configuration with a width dimension of approximately 4.75 inches and a length dimension of approximately 5.37 inches. The carrier tray member 11*a* consists of a bottom wall 24, opposed sidewalls 26*a* and 26*b*, and opposed end walls 28. The sidewalls 26*a*, 26*b* and end walls 28 are joined integrally to the edges of the bottom wall 24 and extend vertically therefrom so as to form a central cavity portion 30. Each of the sidewalls and end walls has a height of about 1.17 inches. At the upper free end of the sidewalls and end walls, there are provided ledge portions 32*a*–32*d* disposed in a surrounding relationship with the sidewalls and end walls.

As can be seen from FIG. 3–6, the sidewall 26*a* has formed along its interior surface a plurality of ribs 34*a* which are disposed in an equally spaced apart relationship so as to define vertical slots 36*a* therebetween. Each of the ribs 34*a* extends vertically from the bottom wall 24 and terminates a short distance from the ledge portions 32*a*. Similarly, the sidewall 26*b* also has formed along its interior surface a plurality of ribs 34*b* which are disposed in an equally spaced apart relationship so as to define vertical slots 36*b* therebetween. Each of the ribs 34*b* extends vertically from the bottom wall 24 and terminates a short distance from the ledge portion 32*c*. The ribs 34*b* and the slots 36*b* formed on the sidewall 26*b* are equal in number to the ones formed on the sidewall 26*a* and are in corresponding alignment with the same. For example, in order to accommodate the packing and shipping of fifteen PCMCIA cards 12 the sidewalls 26*a*, 26*b* are required to have fourteen ribs so as to form the fifteen slots for receiving separately therein a corresponding one of the PCMCIA cards 12.

The card carrier tray member 11*a* is of a single-piece construction and is preferably formed of a suitable plastic material such as polyvinyl chloride (PVC), polycarbonate, or polyethylene or the like which may be fabricated by a conventional injection molding process or vacuum forming. The plastic material is preferably treated or coated with an appropriate additive so as to render it anti-static or static-dissipative as required. It should be noted that the carrier tray member 11*a* may have different widths and length dimensions so as to accommodate any number of ribs and slots for storing a desired quantity of PCMCIA cards 12 therein.

Further, the bottom wall 24 of the carrier tray member 11*a* includes a depressed intermediate area 37 which is sandwiched between opposed rows 38, 40 of narrow protrusions 42*a*, 42*b*. The narrow protrusions 42*a* on the opposed row 38 are in alignment with the narrow protrusions 42*b* on the opposed row 40. The respective protrusions 42*a*, 42*b* are also aligned to corresponding ribs 34*a*, 34*b* on the respective sidewalls 26*a*, 26*b*. The protrusions 42*a* (42*b*) are likewise equally spaced apart from each other so as to form channels 44*a* (44*b*) therebetween. The channels 44*a*, 44*b* are aligned with the corresponding slots 36*a*, 36*b* in the opposed sidewalls 26*a*, 26*b*.

Interlocking snapping means consisting of a projecting tab 46 and a recess 48 are formed adjacent the opposed ends of the ledge portions 32*a* and 32*c* of the carrier tray member 11*a* which are designed so that the projecting tabs 46 can be snapped into frictional engagement with corresponding recesses 48 on the ledge portions of the carrier cover member 11*b*. Further, interlocking twisting means consisting of flexible fingers 50 and notches 52 are formed on the intermediate section of the ledge portions 32*a*–32*d* of the carrier tray member 11*a* which are designed so that the fingers can be twisted so as to frictionally engage with corresponding fingers and notches on the ledge portions of the corresponding cover member 11*b*. In this manner, the interlocking snapping means and the interlocking twisting means serve to latch together the tray member 11*a* and the cover member 11*b*.

In use, a predetermined number of PCMCIA cards 12 (i.e., fifteen) are loaded or packed between the ribs 34*a*, 34*b* on the respective sidewalls 26*a*, 26*b* of the carrier tray member 11*a* so as to completely fill the same. As can best be seen from FIG. 2, it will be noted that the slots 36*a*, 36*b* on the opposed sidewalls 26*a*, 26*b* contact or engage with the opposed end edges 16*a*, 16*b* of the PCMCIA card 12 with the ribs 34*a*, 34*b* supporting the top and bottom surfaces 18, 20 thereof adjacent the opposed end edges. Further, one of the side edges 14*a* of the PCMCIA card 12 is retained in the channels 44*a*, 44*b* of the bottom wall 24 with the corresponding protrusions 42*a*, 42*b* supporting the top and bottom surfaces thereof between the opposed end edges.

Next, a second tray member is turned over or flipped upside-down so as to function as a carrier cover member 11*b* (FIG. 2). The cover member 11*b* is then lowered over the PCMCIA cards 12 in the tray member 11*a* so that the free side edges 14*b* thereof will become inserted into the corresponding slots and channels in the cover member 11*b*. Simultaneously, the projecting tabs 46 on the ledge portion of the cover member will become inserted into the corresponding recesses 48 on the ledge portion of the tray member. Thus, the ledge portions 32*a*–32*d* on the cover member will come to rest flush against the corresponding ledge portions on the tray member 11*a*. In addition, the fingers 50 on the ledge portions thereof will be twisted to rest on top of the corresponding fingers on the cover ledge portions so as to lock or latch together the tray and cover members.

The tray/cover carrier may now be suitably transported from the PCMCIA card manufacturer's site to an assembly station at a customer's site where further assembly operations can be performed. At the customer's site, the fingers on the cover and tray members are twisted so as to unlock the same, and the cover member can be lifted away from the tray member so as to allow access to the PCMCIA cards. Therefore, the overall assembly operation has been greatly simplified and the packaging costs of the PCMCIA cards has been significantly reduced. It should be appreciated by those skilled in the art that the PCMCIA card carrier, after it has been completely unloaded at the customer's site, can be reused since it is made of a durable plastic material.

From the foregoing detailed description, it can thus be seen that the present invention provides an improved PCMCIA card carrier for packing and shipping of a plurality of PCMCIA cards in a vertical side-by-side arrangement. The PCMCIA card carrier of the present invention includes a tray member having a plurality of first ribs disposed in a equally spaced apart relationship so as to form first vertical slots therebetween and a cover member having a plurality of second ribs disposed in an equally spaced apart relationship so as to form second vertical slots therebetween. When the cover member is placed on top of the tray member, the plurality of second ribs in the cover member are vertically aligned with corresponding ones of the plurality of first ribs in the tray member.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

Claims:

1. A PCMCIA card carrier for packing and shipping of a plurality of PCMCIA cards in a vertical side-by-side arrangement, said carrier comprising:

a rectangularly-shaped tray member being formed of a first bottom wall, opposed first sidewalls, and opposed first end walls all integrally joined together so as to form a first central cavity portion;

each of said opposed first sidewalls including a plurality of first ribs disposed along its interior surface in an equally spaced apart relationship so as to form first vertical slots therebetween;

said plurality of PCMCIA cards being disposed vertically in corresponding ones of said vertical slots for packing and storing the same;

a rectangularly-shaped cover member being formed of a second bottom wall, opposed second sidewalls, and opposed second end walls all integrally joined together so as to form a second central cavity portion;

each of said second opposed sidewalls including a plurality of second ribs disposed along its interior surface in an equally spaced apart relationship so as to form second vertical slots therebetween; and said plurality of second ribs in said cover member being vertically aligned with corresponding ones of said plurality of first ribs in said tray member when said cover member is placed on top of said tray member.

2. A PCMCIA card carrier as claimed in claim 1, wherein each of said tray and cover members is formed of a single-piece construction.

3. A PCMCIA card carrier as claimed in claim 1, wherein each of said tray and cover members is formed of a plastic material.

4. A PCMCIA card carrier as claimed in claim 1, wherein each of said tray and cover members is formed of polyvinyl chloride.

5. A PCMCIA card carrier as claimed in claim 1, wherein each of said first and second vertical slots is dimensioned so as to conform to the contour of said plurality of PCMCIA cards.

6. A PCMCIA card carrier as claimed in claim 1, wherein each of said tray and cover members has a width dimension of approximately 4.75 inches and a length dimension of approximately 5.37 inches.

7. A PCMCIA card carrier as claimed in claim 1, wherein said opposed sidewalls and opposed end walls on said tray and cover members are joined integrally to edges of said bottom wall and extend vertically therefrom so as to form the first and second central cavity portions.

8. A PCMCIA card carrier as claimed in claim 7, further comprising ledge portions being formed on upper free ends of said opposed sidewalls and opposed end walls of said tray and cover members.

9. A PCMCIA card carrier as claimed in claim 1, wherein said bottom wall of said tray and cover members include a depressed intermediate area sandwiched between opposed rows of narrow protrusions to support top and bottom surfaces of said plurality of PCMCIA cards.

10. A PCMCIA card carrier as claimed in claim 8, further comprising locking means formed on said tray and cover members so as to latch together said cover member with said tray member.

11. A PCMCIA card carrier as claimed in claim 10, wherein said locking means is comprised of snapping locks consisting of a projecting tab and a recess disposed adjacent opposed ends of said ledge portions on opposed sidewalls of said tray and cover members.

12. A PCMCIA card carrier as claimed in claim 11, wherein said locking means is further comprised of twisting locks consisting of flexible fingers and notches disposed on the intermediate areas of said ledge portions of said opposed sidewalls and opposed end walls of said tray and cover members.

13. A PCMCIA card carrier for packing and shipping of a plurality of PCMCIA cards in a vertical side-by-side arrangement, said carrier comprising:

tray means having a plurality of first vertical slots disposed therein;

a plurality of PCMCIA cards disposed in said plurality of first vertical slots; and cover means having a plurality of second vertical slots disposed therein which are vertically aligned with corresponding ones of said first vertical slots in said tray means when said cover means is placed on top of said tray means.

14. A PCMCIA card carrier as claimed in claim 13, wherein each of said tray and cover means is formed of a single-piece construction.

15. A PCMCIA card carrier as claimed in claim 13, wherein each of said tray and cover means is formed of polyvinyl chloride.

16. A PCMCIA card carrier as claimed in claim 13, wherein each of said first and second vertical slots is dimensioned so as to conform to the contour of said plurality of PCMCIA cards.

17. A PCMCIA card carrier as claimed in claim 13, further comprising ledge means formed on said tray means and cover means.

18. A PCMCIA card carrier as claimed in claim 17, further comprising locking means formed on said ledge means for latching together said cover means with said tray means.

19. A PCMCIA card carrier as claimed in claim 18, wherein said locking means is comprised of snapping locks consisting of a projecting tab and a recess disposed adjacent opposed ends of said ledge portions on opposed sidewalls of said tray and cover members.

20. A PCMCIA card carrier as claimed in claim 19, wherein said locking means is further comprised of twisting locks consisting of flexible fingers and notches disposed on the intermediate areas of said ledge portions of said opposed sidewalls and opposed end walls of said tray and cover means.

* * * * *